United States Patent [19]

Warshaw et al.

[11] 4,039,367

[45] Aug. 2, 1977

[54] TAPE APPLYING MECHANISMS OF CARTON SEALING MACHINES

[75] Inventors: Saul Warshaw, Hawley, Pa.; Winton Loveland, Fort Salonga; Horst J. Hanemann, Manhasset, both of N.Y.

[73] Assignee: The Loveshaw Corporation, Deer Park, N.Y.

[21] Appl. No.: 645,718

[22] Filed: Dec. 31, 1975

[51] Int. Cl.[2] ..... B65C 1/06

[52] U.S. Cl. ..... 156/486; 156/492; 156/580

[58] Field of Search ..... 156/476, 482, 486, 489, 156/522, 580, 468; 93/36.9

[56] References Cited

U.S. PATENT DOCUMENTS

| | | | |
|---|---|---|---|
| 2,596,158 | 5/1952 | Lindsey | 156/486 |
| 2,726,783 | 12/1955 | Erickson | 156/522 |
| 3,123,513 | 3/1964 | Snyder | 156/522 |
| 3,540,969 | 11/1970 | Jorgensen | 156/522 |
| 3,558,254 | 1/1971 | Cahill | 93/36.9 |
| 3,577,303 | 5/1971 | Buck | 156/522 |
| 3,616,078 | 10/1971 | Howard | 156/486 |
| 3,617,412 | 11/1971 | Schenderling | 156/461 |
| 3,800,679 | 4/1974 | Bartelheimer | 156/522 |
| 3,915,786 | 10/1975 | Collett et al. | 156/522 |
| 3,939,034 | 2/1976 | Tanaka et al. | 156/522 |

FOREIGN PATENT DOCUMENTS 1,019,761 2/1966 United Kingdom

*Primary Examiner*—Charles E. Van Horn
*Assistant Examiner*—Basil J. Lewris
*Attorney, Agent, or Firm*—Watson, Leavenworth, Kelton & Taggart

[57] ABSTRACT

Tape applying mechanism of carton sealing machines for feeding pressure sensitive tape having an uncoated back side and an adhesively coated face and to apply the latter to end panels of an advancing carton and lap it over the opposed longitudinal edges of folded-in side flaps of such carton. It includes means to guide the tape along a path extending toward and for lap against a wipe-on applicator cylindrical roller that is movably supported for swing toward and away from a carton travel path with the adhesively coated face exposed outward away from this roller. This invention is chiefly concerned with means immediately preceding the wipe-on roller for guiding the tape to and lapping its back side against this roller with shaping of the tape by transverse bowing to provide a longitudinal stiffening midrib in its adhesively coated face for substantially flop-free guidance of the tape to said roller cylindrical surface with the latter smoothing out the tape to substantially flat disposition by the lap thereagainst for substantially flat application to opposed carton surfaces against which this roller is rolled.

5 Claims, 8 Drawing Figures

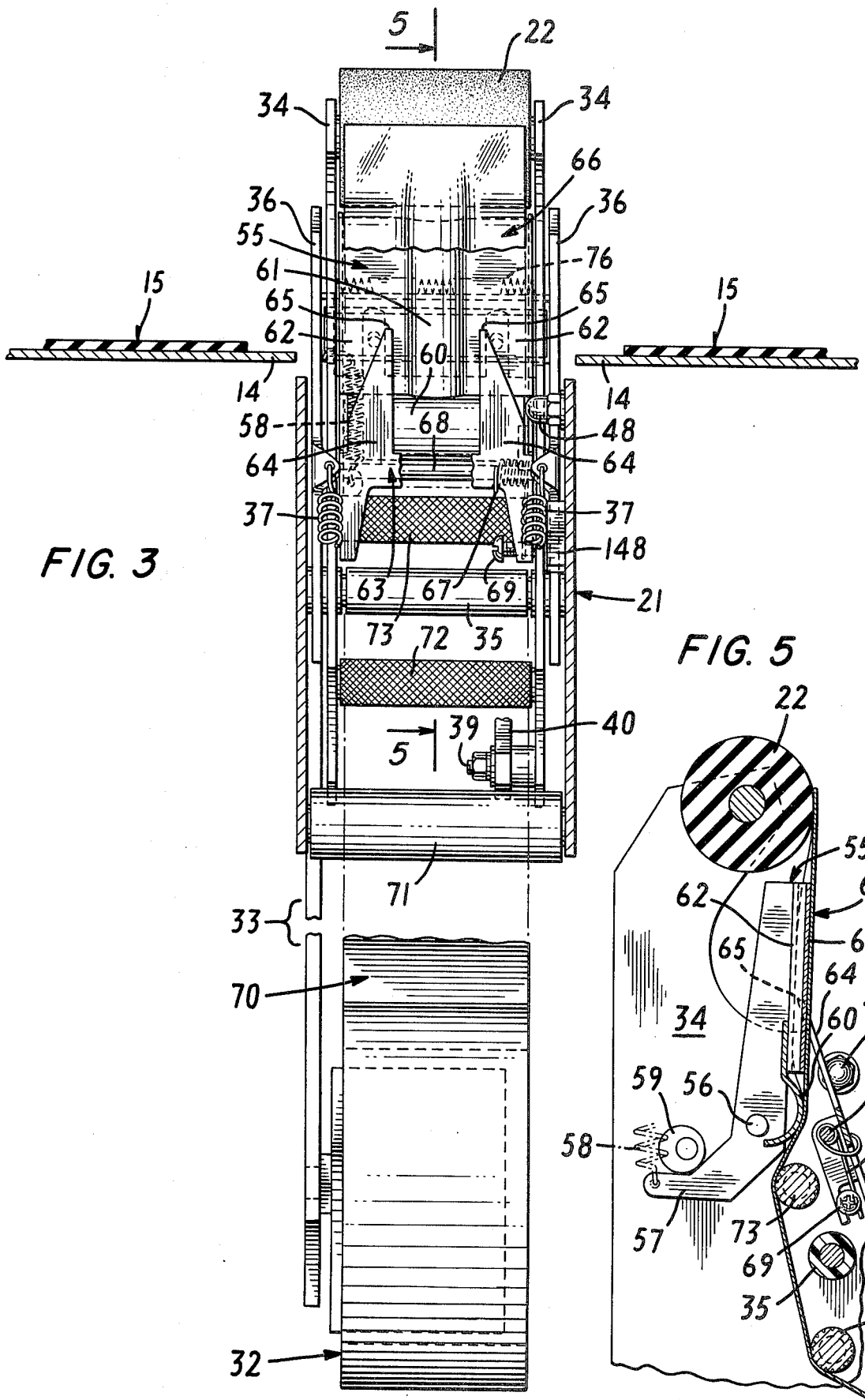
FIG. 3
FIG. 5
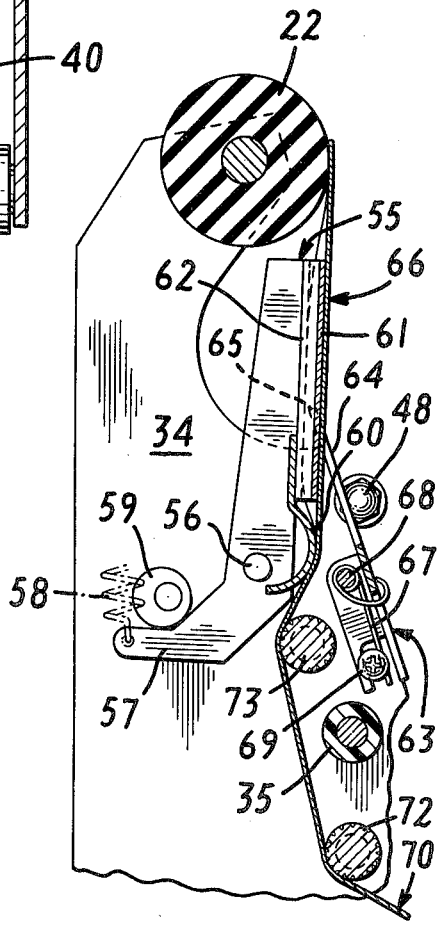

TAPE APPLYING MECHANISMS OF CARTON SEALING MACHINES

BACKGROUND AND SUMMARY

The present invention is concerned with the mechanism for applying pressure sensitive tape to cartons having their end and side flaps folded inward, to anchor those folded flaps securely. It is an old practice in the concerned art to provide such machines which receive from an opertor's hands or equipment he controls cartons with their flaps folded over contained contents, and to apply to each carton pressure sensitive tape for securely anchoring in closed positions the folded carton flaps. These machines are equipped with tape applying assembly units each of which frequently has two tape applicator rollers that are pivotally mounted for swing. In some the unit has a single first roller projecting into a path of transport of each carton through the machine and with this roller supporting an end of the tape with its adhesively coated face opposed to the leading end wall of the on-coming carton for adherence anchorage thereto. Then, as the carton advances, it swings this first applicator roller forward to lower it out of the way of the oncoming carton while wiping the adhesive tape to anchorage of carton surfaces, i.e., first a portion of the carton leading end wall surface, then along the longitudinal top (or bottom as the case may be) to lap the opposed edges of the infolded side flaps and finally to leave a trailing end section to lap up (or down as the case may be) against the trailing carton end wall by one of the remaining pair of applicator rollers. This pair of rollers constitute with their carrying arms a sub-assembly which is pivoted to supporting frame structure of the mechanism and the carrying arm of the one thereof nearest to the first roller is linked by a coupling means to the carrying arm of this first roller, so that as the latter is depressed by advance of the carton for wiping of the tape thereby longitudinally along the carton, the swing of the first roller's carrying arm forward swings back the carrying arm of the second roller to cause the latter to repeat the wipe against the tape laid down longitudinally until the carton back wall is reached. This piece of tape is cut off by a knife pivotally supported by the first roller carrying arm and the resultant trailing free end is then wiped over the carton trailing back corner and against the carton back end wall to complete the tape application operation.

If the pressure sensitive tape is of relatively thick plastic stock it may have sufficient stiffness to resist effectively a tendency of a free severed end to flop around as it is being swung toward an advancing carton end wall, or as its back section is severed from the tape being drawn from its supply source. This flopping around of thinner such tape frequently causes portions of its adhesively coated face to engage parts of the applying mechanism for adherence thereto, and also short lengths thereof to stick and loop together, so that such tape does not adhere to the carton and ultimately an adhering tangle of fouling tape is caused which requires machine shut-down and tangle removal. Such tape is quite expensive and thus use of thinner gauges thereof can represent an appreciable cost economy, which is permitted because of the great strength of such tape even in very thin gauges.

It is thus an object of the present invention to provide such tape applying equipment with quite simple additive means which effectively reduces such flopping about tendencies and the attendant uneconomical losses of time and tape sections in an unusually economical manner while permitting the practical use of very thin and thus much cheaper pressure sensitive tape.

Another object of the present invention is to solve this problem to the satisfaction of the machine owner or user by mounting the additive means directly on the first applicator roller carrying means while avoiding any necessity for appreciable redesign of the other parts of the standardized mechanism.

A further object of the invention is to provide such additive means in a form which is quickly and economically constructed and easily installed in the basic tape applying equipment.

In accordance with the present invention a typical embodiment of the tape cartridge that has been improved by the addition thereto of equipment of this invention may have been installed in the machine base to perform as follows. A loaded carton may be pushed by hand into the entry end of the machine and it will be abutted against a control on the lowered head beam to cause side rails to be moved in to opposite sides of the carton and the head beam to be raised out of the path of the carton so that it can move forward to abut against the first wipe-on tape applicator roller. The upstanding end of the pressure sensitive tape will adhere to the front or leading end wall of the advancing carton. The continued forward travel of the carton will pull the tape off of the tape supply or roll thereof. The tension of the tape is adjustable through a brake on the core which supports the tape roll supply. As the tape is pulled through the cartridge by the advancing carton this tape travels up over means immediately preceding this first wipe-on roller for guiding the tape to and lapping its back side against this roller with shaping of the tape by transverse bowing to provide a longitudinal stiffening mid-rib in its adhesively coated face for substantially flop-free guidance of the tape to this roller's cylindrical surface. This roller cylindrical surface smoothes out the tape to substantially flat disposition by lap thereaginst for substantially flat application to opposed carton surfaces against which this roller is rolled. Preferably, this guiding means may comprise a pivoted guide plate overlaid by a tape biasing fork, with the pulled tape traveling up therebetween. This tape guide plate is spring loaded toward a stop which orients its face surface toward alignment with a tangent of this first roller cylindrical surface and the biasing fork is spring loaded back toward the guide plate surface to snug the traveling tape back against this ribbed guide plate face to bow or arch the traveling tape transversely for providing a medial crowned rib extending longitudinally along the central zone of the take for stiffening its end section extending to the first applicator roller so as to reduce or eliminate any tendency to flop about. The uncoated back side of the tape rides over a convexed transverse ridge at the back end of the tape guide plate which prevents the tape from wrinkling. The pair of transversely spaced fingers of the fork drag lightly against the adhesively-coated tape face on opposite sides of a longitudinally convexed and central rib.

Other objects of the invention will in part be obvious and will in part appear from reference to the following detailed description taken in connection with the accompanying drawings, wherein like numerals identify similar parts throughout, and in which:

FIG. 1 is a perspective view of a carton taping machine in which tape applying mechanism of the present invention is embodied, preferably as like unitary cartridges in both the machine base and in the elevating head beam;

FIG. 2 is an elevational sectional view to larger scale, with parts broken away, of the machine base and head beam, showing a loaded carton with its top and bottom end and side flaps infolded that is entering therebetween for application of adhesive tape and anchorage of such folded flaps, showing the leading end wall of the carton in a position at the instant of abutment to the upstanding first tape applicator roller;

FIG. 3 is a vertical sectional view, with parts broken away, taken substantially on line 3—3 of FIG. 2;

FIG. 5 is an enlarged sectional detail, with parts broken away, of the first applicator roller, its supporting pivoted arms means, and the tape guide sub-assembly mounted therein;

Figure 2:
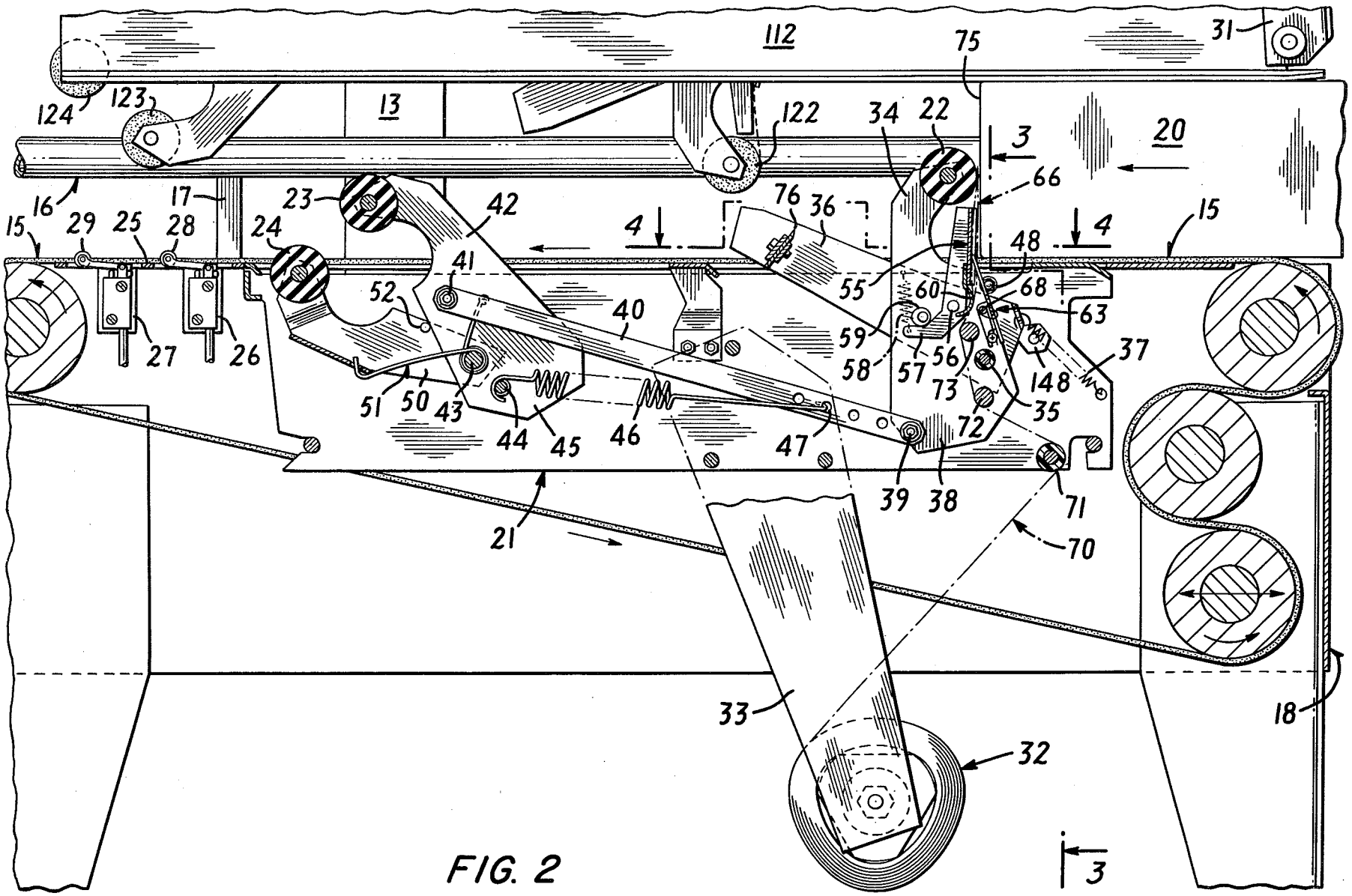
Figure 6:
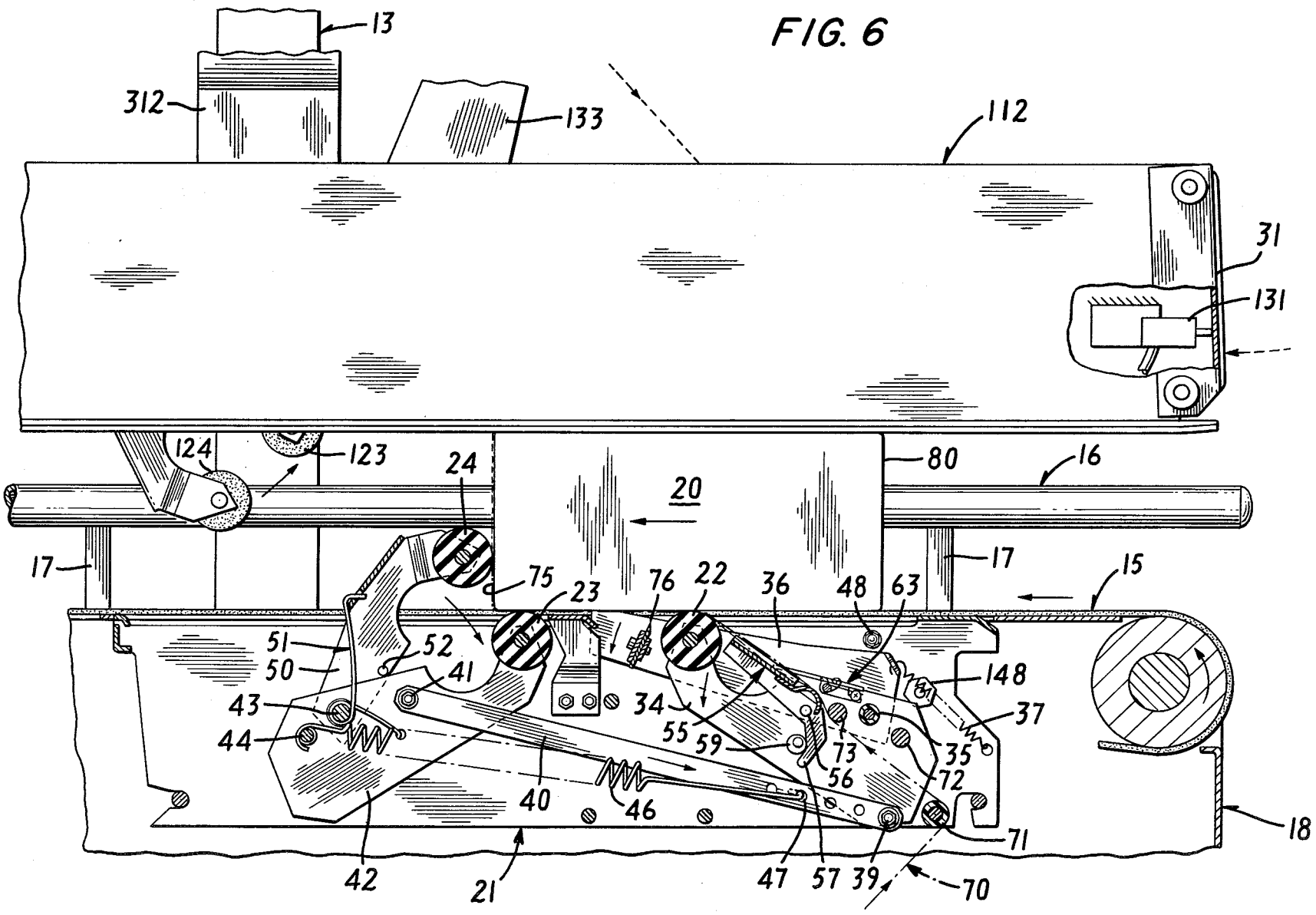
Figure 7:
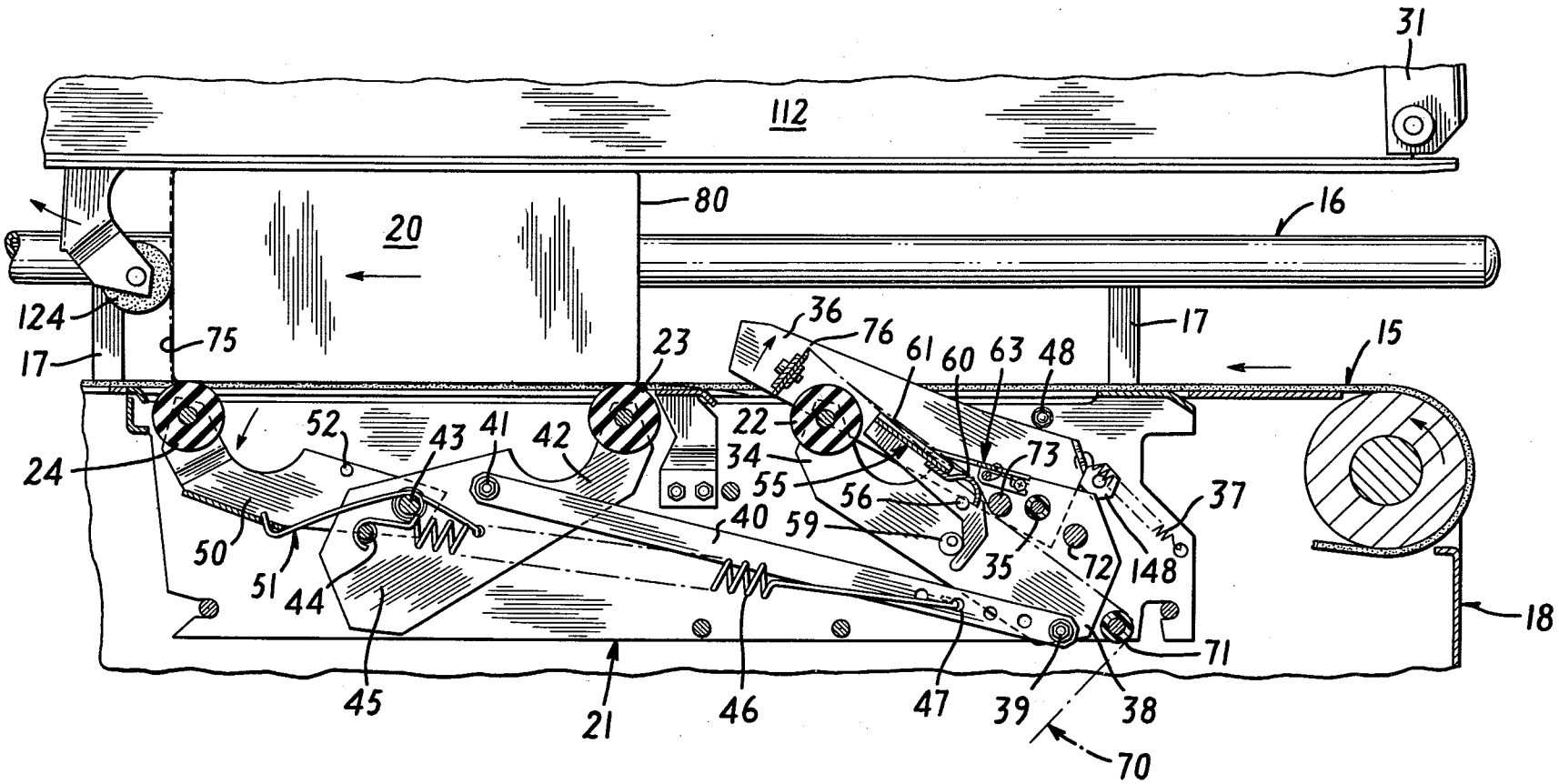
Figure 8:
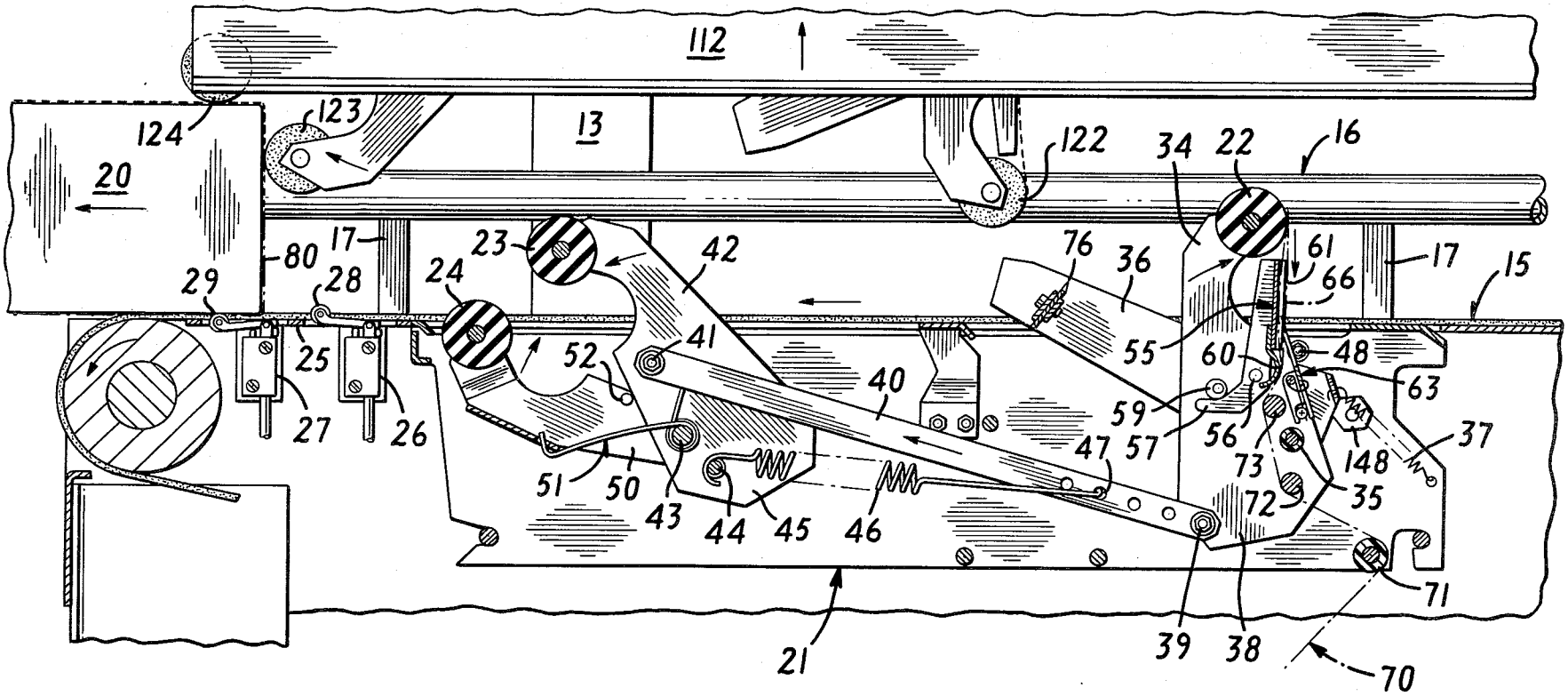

FIG. 6 is a longitudinal elevational section of the tape applying machine, with parts broken away, and somewhat similar as to parts shown in FIG. 2, more of the head beam being illustrated while less of the machine base is shown, and illustrating the location of the carton as it has advanced to contact of its leading end wall and bottom just behind the latter by the second and third applicator rollers;

FIG. 7 is vertical sectional view somewhat similar to FIGS. 2 and 6 with respect to parts illustrated therein, with parts broken away, and showing the further advance of the carton through the machine at a time when the first applicator roller has been freed from contact therewith and at the instant of tape severance to separate the section of the tape draped along the carton leading end wall and medially of its bottom just prior to lap of the severed end of such tape section up about the carton trailing bottom corner and against its trailing end wall; and FIG. 8 is a vertical sectional view, with parts broken away, showing the position of the carton relative to the bottom tape applying mechanism cartridge, and as to that which is located in the head beam slightly forward thereof as it completes the application of such a strip of pressure sensitive tape over the top of the carton.

Figure 1:
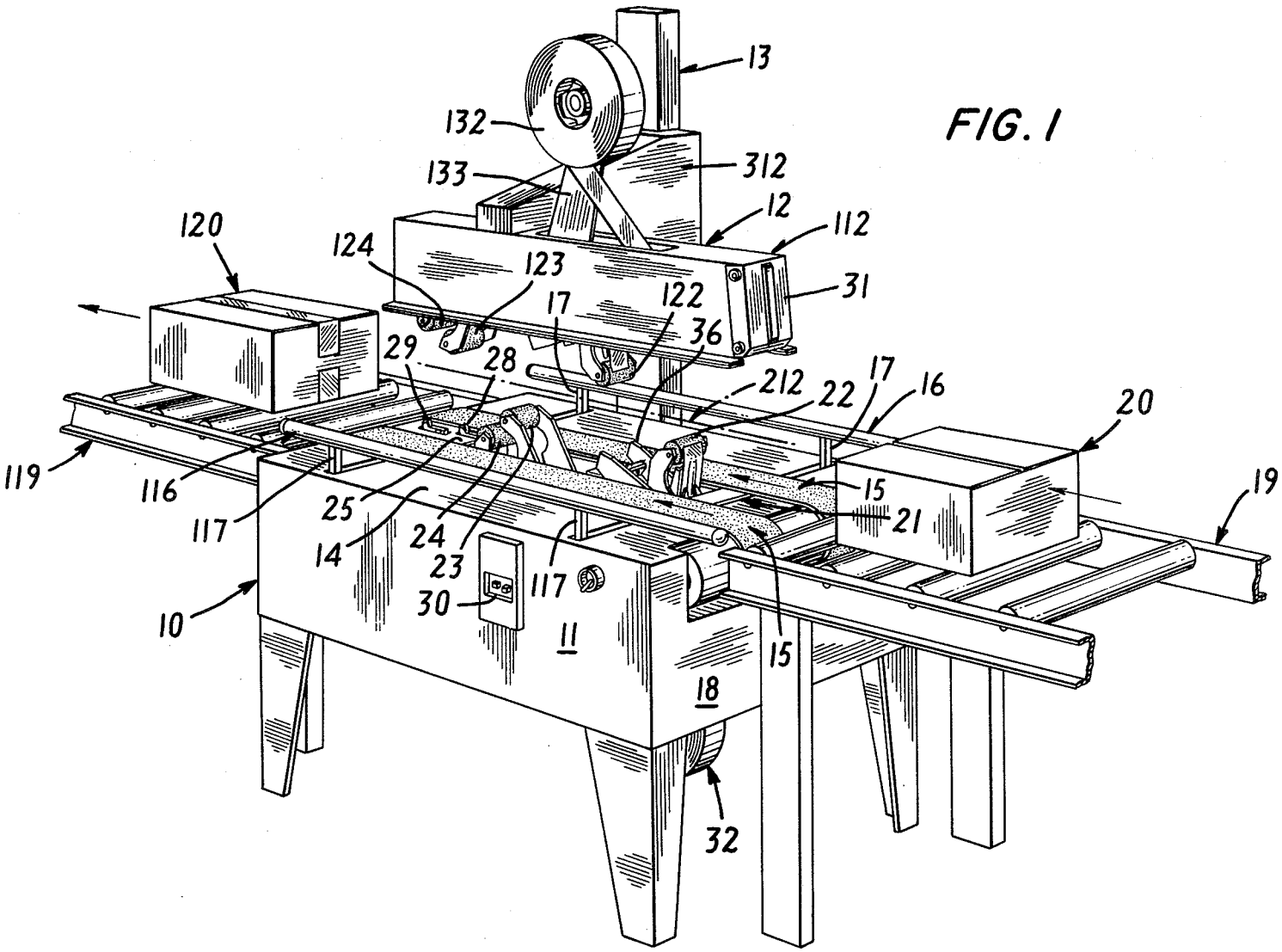

The carton sealing machine which embodies the tape applying mechanism that includes the present invention is illustrated at 10 in FIG. 1, wherein it is shown that it includes a lateral base structure 11 and an elevator head beam structure 12 with the latter supported, for slidable up-and-down movement, on a vertical column 13 that is mounted on the back side of the base structure.

The base structure 11 is provided with a substantially horizontal top panel 14 over which are driven the top runs of a pair of transversely-spaced, endless, carton-transporting belts 15. Above the base top panel 14 is supported a pair of longitudinally-extending carton-clamping side rails 16 and 116, with each suitably supported by upstanding arms 17 and 117 that are free to be moved transversely in slots in this top panel by equipment within the base structure which will cause the side rails to move alternatively and simultaneously toward and away from each other. Such side rail driving equipment may be any suitable powered means and preferably can be a pneumatic cylinder motor connected to the support structure of one of these side rails for moving it inward and outward sideways, and with the opposed side rail support structure being connected thereto by suitable linkage.

The entrance end 18 of the base structure may be preceded by a suitable roller table 19 on which an attendant may rest an empty carton with its bottom end flaps and side flaps folded inwardly for closure thereof to allow such attendant to load the carton chamber and then infold the top end flaps and side flaps, as is indicated at 20, all in well-known manner. The exit end of the machine bed 11 may also be equipped with a roller table 119 for receiving a loaded carton 120 after application of strips of sealing tape thereto.

Between the laterally-spaced top runs of the pair of transporting belts 15 the central zone of the machine bed 11 is cut away or provided with a longitudinal slot into which a tape applying mechanism cartridge 21 is inserted downward for suitable anchorage in a position to expose above the top panel 14 its three cylindrical wipe-on or applicator rollers 22, 23, and 24 for successive engagement by the loaded carton 20 as it is transported forward by the endless transporting belts 15. Beyond the exit end of this tape applying cartridge unit 21 this base top panel also supports a control unit 25 which carries a pair of controls 26 and 27 (FIG. 2) that are mechanically manipulated respectively by triggers 28 and 29 which extend upwardly into the path of the bottom portion of the forwardly transported loaded carton, for successive depression thereof to manipulate these control valves in sequence.

The entrance end of the machine base structure 11 is provided at a convenient point with a manually operable pushbutton control 30 which activates the machine for operation and at such time the beam 112 of the elevator head 12 will be lowered to its lowest position, such as for example, to an elevation as is illustrated by the broken center line 212, so that a hinged end panel 31 which is carried by the approach end of the head beam 112 will be abutted by the leading end wall of the oncoming carton 20 for manipulation of a pneumatic valve (131 of FIG. 6) for causing the head beam to be raised clear of the top of such oncoming carton until this control 31 is freed for stopping the rise of the head beam at the top of such forwardly traveling carton. In this manner the head beam is cleared from the path of the oncoming carton and is then permitted to rest down upon or load the top of such carton during its forward travel so that the manipulative action of the application of the tape drawn from its supply roll 32, to the leading and trailing end walls and the bottom of the carton by the tape applying rollers 22, 23, and 24 will not cause any portion of the carton to rise from the transport belts 15 and interfere with the proper application of the tape. This raising of the head beam 112 is effected by suitable pneumatic means in the machine base and support column 13 for suitable adjustment of the elevation of such head beam by its supporting bracket 312.

It will also be noted that the head beam 112 supports an inverted substantial duplicate of the tape applying mechanism cartridge 21, with the tape supply in the form of a roll 132 which is supported by a suitable upstanding arm 133 that is mounted to the cartridge internally of the head beam 112.

As will be seen from FIG. 2 the first tape applicator roller 22 is pivotally carried by a pair of transversely-spaced pivoted arms 34 that are swingable about an axle shaft 35, which also pivotally supports a pair of transversely-spaced knife-carrying arms 36 that are spring biased by a pair of springs 37 toward an upwardly-extending position of tape severancing with limitation of such upward swing by a stop 148. A depending end 38 of one of the roller-supporting arms 34 has pivotally mounted thereto at 39, below the shaft 35, a connecting link or coupling rod 40 with the other end of the latter pivotally mounted at 41 to another pair of transversely-spaced arms 42 which are pivotally mounted to a cross-bar 43 for swing about the latter. The arms 42 rotatably support the second applicator roller 23, and a cross pin 44 extending between lower portions 45 thereof serves as an anchor for one end of a tension spring 46 which has its other end connected at 47 to the coupling rod 40, for biasing the pair of arms 34 which carry the applicator roller 22 in an upright position determined by stop pin 48.

The third applicator roller 24 is supported by a pair of transversely-spaced arms 50 which is also pivotally supported on cross shaft 43, and a sear-like spring 51 is looped about this shaft with one of its ends anchored to one of the arms 42 laterally of the pivot at 43 and the other of its ends connected to one of the swinging arms 50 for biasing the two sets of arms 42 and 50 toward each other for close approach of the rollers 23 and 24 relative to each other, with such approaching swing of these two sets of arms toward each other preferably being limited by a stop pin 52 carried by one of the arms 50, all as shown in FIG. 2. In an operative structure of this equipment the spring 51 has been duplicated in laterally spaced relation to the one shown in FIG. 2 for balance biasing of this third roller supporting structure.

The sub-assembly of the present invention in preferred embodiment thereof is provided in the form of the following structure which is pivotally supported between the pair of transversely-spaced swinging arms 34 that carry the applicator roller 22. In this preferred form such sub-assembly includes a guide plate 55 (which is shown in FIG. 2, but may best be understood by the showings thereof in FIGS. 3, 4, and 5). Guide plate 55 is pivotally supported between the transversely-spaced roller-supporting arms 34 by means of a pivot shaft 56, with an arm 57 of this plate beyond the pivot shaft 56 being spring-loaded at 58 against an eccentric adjustable stop 59 that is carried by one of the arms 34. Thus, guide plate 55 is held substantially in the position shown in FIG. 2 relative to a tangential plane of the applicator roller 22 for directing the end of the tape in the general direction of this tangential plane for lap against this roller. As will be best understood from FIGS. 3, 4, and 5 this guide plate structure 55 is provided with a transversely-extending crowned rib 60 at the heel of the major portion thereof in the vicinity of the pivot 56, and a longitudinal crowned rib 61 is formed medially in its relatively flat top surface to extend from the transverse rib 60 to the tip end of this plate. The chief purpose of the cross or transverse crowned rib 70 is to elevate the tape being drafted thereover along the main portion of the guide plate 55 toward the applicator roll 22 to about the elevation of the crown of the longitudinal rib 61 extending on the top surface of this guide plate, so as to facilitate the draft of the uncoated back surface of the tape up over and along this longitudinal crowned rib. The adhesively-coated tape web may vary slightly in direction toward a tangential plane from the side surface of the first applicator roller to a longitudinal surface of the guide plate. For example, this plane may encompass the crown line of the longitudinal rib or longitudinal straight lines of the guide plate edge zones flanking this rib, or lie between such two extreme positions.

Figure 4:
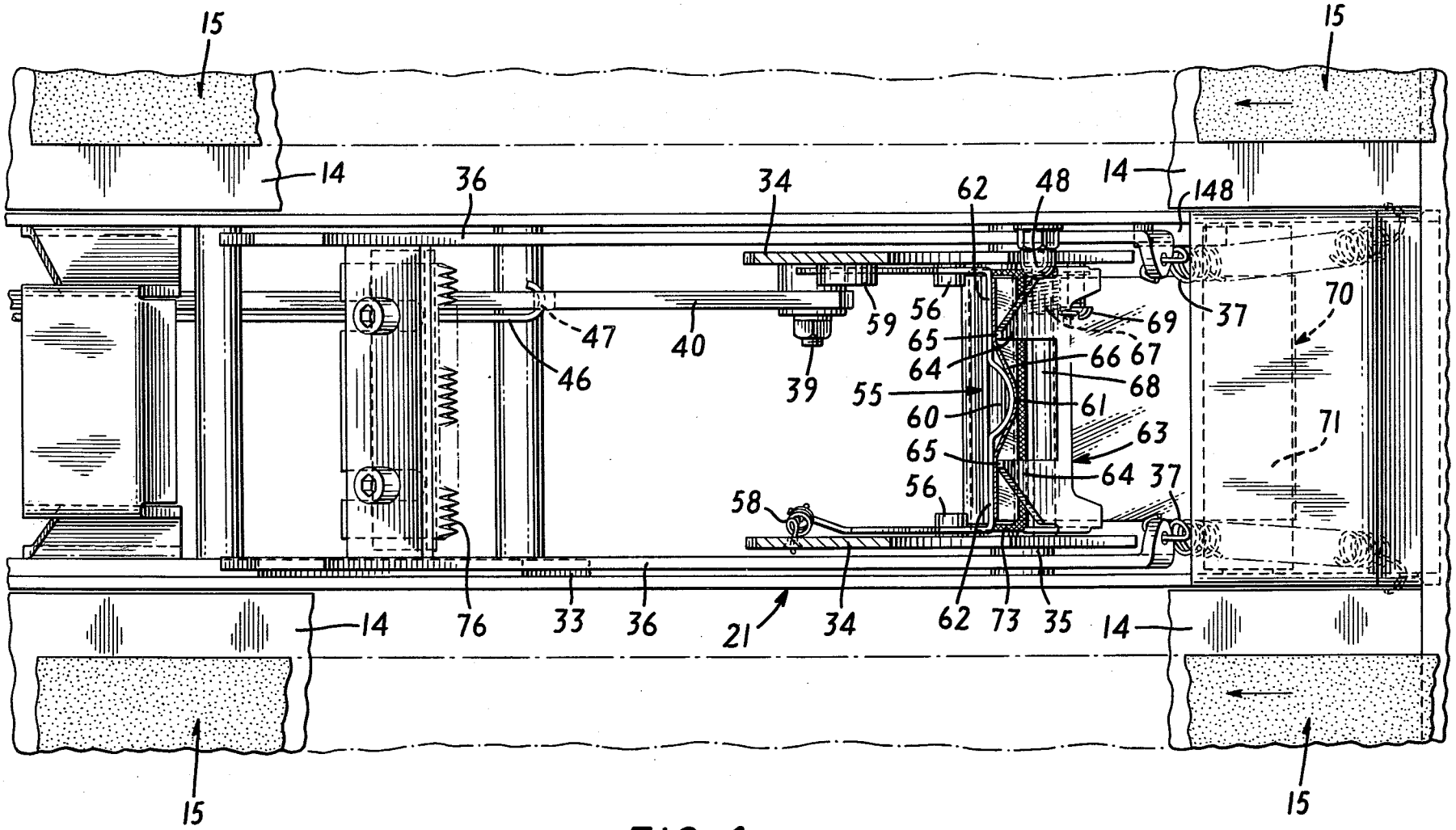
FIG. 4 is a sectional view, with parts broken away, taken substantially on line 4—4 of FIG. 2.

In order that such shaped or ribbed guide plate 55 will perform its intended function of curving the tape drafted thereover in a longitudinally crowned shape means are provided for snugging the longitudinal edge zones of this tape to flat edge zones 62,62 flanking opposite sides of the longitudinal crowned rib 61. This snugging means may be provided in the form of a pivoted fork 63 having a pair of laterally-spaced fingers 64,64 provided with relatively narrow tips 65 which are shown in FIGS. 3, 4, and 5 to be laterally tapered to blunt pointed ends that are very narrow to provide a pair of laterally separated contact elements adapted to bear against and lightly drag substantially in line contact along the adhesively coated surface of the piece 66 that is drafted therepast. This longitudinal crowned rib 61 causes the medial transverse bowing of the tape end section to provide the longitudinal stiffness thereof so that its terminal end will lap flat against the adjacent portion of the periphery of the applicator roller 22, as will best be seen from FIGS. 3 and 5. Suitable means are provided for lightly biasing these finger tips 65 against the adhesively coated side zones of the piece of tape 66 that is being drafted toward and over the applicator roller 22, and this biasing may be in the form of a spring 67. The fork 63 is pivotally supported by transverse shaft 68 and the swing thereof is appreciably limited to a small degree by a stop 69 (FIGS. 3 and 5).

It will thus be understood from FIGS. 2 and 5 inclusive that the tape in the roll 32 will have its end section 70 drafted therefrom by pull effected at the applicator roller 22 when it causes the adhesively coated side thereof to engage the leading end wall of a carton 20 and the carton moves forward with pull upon this end section 66 of this piece of tape. The section 70 of the tape is drafted progressively from the roll by lap of its uncoated back side against a roller 71 to successive lap of its adhesively coated face against knurled rollers 72 and 73 and up over the transverse crowned rib 60 to slide along and be longitudinally shaped over the longitudinally crowned rib 61 of the guide plate 55 for extension of its end section 66 to the back side of the applicator roll 22, the effect the contact thereof to the leading end wall 75 of the advancing carton.

The movement of the carton forward from the position shown in FIG. 2 provides the draft upon the tape end section 66, first to adhere it to the advancing or leading end wall 75 of the carton, then about the lower transverse corner of the latter, and then back centrally and longitudinally of the bottom of the carton where the infolded side flaps are opposed to each other for lap of edge zones thereof to adhere them snugly together.

The first portion of this tape applicating action is illustrated in FIG. 2 and the next advanced position is illustrated in FIG. 6 wherein it is indicated that the medial portion of the bottom of the carton is advancing over the first applicator roller 22 with attendant engagement of the second applicator roller 23 and the third applicator roller 24 respectively against the first portion of the bottom medial zone of the advancing carton 20 and the leading end wall 75 of this carton. Thereafter, the first applicator roller 22 is freed from contact of the further advancing carton 20 so as to free contact of the applicator roller 22 from its bottom and shortly thereafter the contact of the upwardly spring-biased, transversely-spaced pivoted arms 36 which carry the severing knife 76. Upon the back or trailing end 80 of the carton passing the swinging knife 76 with severance of the tape thereat the supporting arms means 34 which carry the transverse applicator roller 22 will swing backward from its position in FIG. 7 to the initial upright position, as is illustrated in FIG. 8 and also in FIG. 2, for a repeat of the operation.

Just prior to such recocking of the first applicator roller carrying arms structure 34 from the FIG. 7 position to the FIG. 8 position the second applicator roller 23 has been swung back to its position of FIG. 7 after the mid-zone of the carton bottom has moved forward to the position illustrated in FIG. 7 so that the carton trailing back end 80 is substantially located thereabove for immediate release of this second applicator roller. The rearward swing of the first applicator roller supporting arms 34 to the upright position of FIG. 8 causes the coupling rod 40 to swing the second applicator roller arms 42 forward to the position of FIG. 8 with scissoring approach of the third applicator roller 24 back theretoward. Thus the parts of the tape applicator mechanism are returned to their initial positions for processing, by application of adhesive tape to walls and opposed edges of infolded side flaps of the next oncoming or advancing loaded carton.

In accordance with the present invention, as the tape is pulled up through the cartridge 21 by the advancing carton 20, due to adherence of the tape end 66 to the carton leading end wall 75, this tape travels up over the guide plate 55 immediately preceding this first wipe-on roller 22 for guiding the tape to and lapping its back side against this roller with shaping of the tape by transverse bowing (FIG. 4) to provide a longitudinal stiffening mid-rib in its adhesively coated face for substantially flop-free guidance of the tape to this roller's cylindrical surface. This roller cylindrical surface smoothes out the tape to substantially flat disposition by lap thereagainst for substantially flat application to opposed carton surfaces against which this roller is rolled. The drafted tape end 66 is pulled up between the guide plate and the overlying spring loaded fork 63 so that its adhesively coated traveling surface is bowed convexly along its longitudinal mid-zone which is moving forward to the first applicator roller so as to reduce or eliminate any tendency to flop about.

In the preceding description, and as supplemented by the disclosures of the drawings, it is made clear that the carton sealing machine 10 may embody a tape applying mechanism cartridge or unit 21 mounted downward into a longitudinal slot in the machine bed 11, as is indicated in lines 1 to 9 incl. of page 9. It is also indicated in lines 16 to 21 incl. of page 10 that an inverted substantial duplicate of the tape applying mechanism cartridge 21 is supported up into the head beam 112. It is further indicated graphically in FIG. 1 that a completely sealed carton 120 is discharged from the exit end of the tape applying machine upon a receiving roller table 119 after lapping of strips of sealing tape thereto longitudinally both down on or over the flap closed top of the carton and up under (to be over) its flap closed bottom by the action of such two tape applying mechanism cartridges respectively in the head beam 112 and in the base structure 11. This application of the separate top and bottom strips of sealing tape is performed as the carton moves forward from the entrance end 18 of the machine base structure through to the discharge end thereof immediately preceding the receiving roller table 119, all in a single pass of the carton through the machine. In FIG. 2 it is indicated that the tape applying mechanism cartridge 21 in the machine base has a strip of sealing tape 70 fed up to the tape applying roller 22 that is positioned in the path of the leading end wall 75 of the carton 20, and that with respect to the tape applying mechanism cartridge which is housed upwardly into the head beam 112 the similar tape appyling roller 122 has tape being fed down thereto within the path of this oncoming leading end wall of the carton. The tape that is being fed up to the roller 22 is indicated by a broken line in the form of alternate dots and dashes and the tape which is being fed down to the roller 122 is indicated by a broken line in the form of a series of successive short dashes. There is shown in FIGS. 6, 7, and 8 the progressive lapping of the two separate pieces of adhesive tape over the folded bottom and folded top lapped flap closures, respectively from the bottom supply and from the top supply to both up under the bottom and down on the top of the carton 20 as it is advanced to produce the finished package 120 illustrated in FIG. 1.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is the novel subjects matter defined in the following claims.

We claim:

1. Tape applying mechanism of carton sealing machines for feeding lengths of pressure sensitive tape each having an uncoated back side and an adhesively coated face bearing pressure sensitive cement and to apply the latter of each tape length to end panels of an advancing carton and lap it over the opposed longitudinal edges of folded-in side flaps of such carton, comprising 1. means to guide the tape along a path extending toward and for lap of its uncoated back side against the outer surface of a wipe-on applicator cylindrical roller that is supported for movement toward and away from a carton travel path with the adhesively coated face exposed outward away from this roller for lapping its adhesively coated face against the leading end panel of an advancing carton and then longitudinally along either the top or bottom wall of this advancing carton,
2. swingable mounting means supporting said wipe-on roller for swing of the latter to effect such movement of it,
3. a guide plate secured to and floatingly mounted upon said swingable roller mounting means for simultaneous and like swing with said roller and having a guide face arranged along the rear side of the tape guide path when the uncoated back side of the tape travels therealong with its adhesive face facing away from said guide face at a near location preceding said applicator roller and with this plate face having a substantially medial longitudinal projecting rib flanked by substantially flat side surfaces to stiffen-bow the adhesively coated tape face outward with flanking side edge zones of the back side of the tape gliding over said flat surfaces, the tape approach path at said face of the guide plate being at least relatively close to parallelism with a plane that is substantially tangential to the cylindrical surface of the applicator roller, and 4. means providing a very small sliding contact tip end bearing lightly against each of the pair of side zones of the tape adhesive side face with light biasing thereagainst to snug the side edge zones back against said side flat surfaces of said guide plate so as to maintain such stiffening bowing of said tape substantially until its back side laps against said cylindrical roller for substantially flop-free guidance of the tape to said applicator roller cylindrical surface and so that the latter smooths out the tape to substantially flat disposition by the lap thereagainst for substantially flat application to opposed carton surfaces against which this roller is rolled.

2. The tape applying mechanism as defined in claim 1 characterized by said guide plate having at its approach end a transverse projecting means immediately preceding the approach end of said longitudinal rib and over which the back side of said tape is to glide so that the tape is there raised for ready gliding onto said longitudinal rib.

3. The tape applying mechanism as defined in claim 1 characterized by said biasing means being in the form of a fork having a pair of laterally-spaced fingers with a tip end of each adapted lightly to drag against the adhesive face of one of the pair of the advancing tape side zones for assuring the stiffening bowing of the tape.

4. The tape applying mechanism as defined in claim 3 characterized by pivoted arm means which movably supports said applicator roller for the swing toward and away from the carton travel path, said guide plate having mounting means pivotally supporting it upon said arm means with spring means biasing said guide plate to its tape path guiding position.

5. The tape applying mechanism as defined in claim 4 characterized by said biasing fork being pivotally carried by said pivoted arm means and relatively narrow tip ends of its pair of fingers lightly biased by spring means toward the adhesively coated face of tape drafted therebeneath toward the applicator roller.

* * * * *

UNITED STATES PATENT AND TRADEMARK OFFICE

CERTIFICATE OF CORRECTION

PATENT NO. : 4,039,367

DATED : August 2, 1977

INVENTOR(S) : Saul Warshaw, Winton Loveland, and Horst J. Hanemann

It is certified that error appears in the above-identified patent and that said Letters Patent are hereby corrected as shown below:

Column 1, line 11, for "opertor's" read --operator's--. Column 2, line 40, for "thereaginst" read --thereagainst--; line 53, for "take" read --tape--. Column 3, line 28, for "is vertical" read --is a vertical--. Column 4, line 30, for "pushbutton" read --push-button--. Column 5, line 55, for "70" read --60--. Column 6, line 42, for "the" (first occurrence) read --to--. Column 8, line 4, for "appyling" read --applying--; line 64, for "said flat" read --said side flat--.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*